US009103307B2

(12) United States Patent
Lingener

(10) Patent No.: US 9,103,307 B2
(45) Date of Patent: Aug. 11, 2015

(54) HIGH-PRESSURE PUMP ARRANGEMENT

(75) Inventor: Uwe Lingener, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 431 days.

(21) Appl. No.: 13/130,094

(22) PCT Filed: Oct. 22, 2009

(86) PCT No.: PCT/EP2009/063924

§ 371 (c)(1), (2), (4) Date: May 19, 2011

(87) PCT Pub. No.: WO2010/060700

PCT Pub. Date: Jun. 3, 2010

(65) Prior Publication Data

US 2011/0223040 A1 Sep. 15, 2011

(30) Foreign Application Priority Data

Nov. 26, 2008 (DE) ..... 10 2008 059 117

(51) Int. Cl.
*F02M 59/10* (2006.01)
*F04B 49/22* (2006.01)
(Continued)

(52) U.S. Cl.
CPC ..... *F02M 59/102* (2013.01); *F02D 41/3854* (2013.01); *F02M 37/0047* (2013.01); *F02M 37/0058* (2013.01); *F02M 37/08* (2013.01); *F04B 49/225* (2013.01); *F04B 23/10* (2013.01)

(58) Field of Classification Search
CPC ..... F02D 41/3854; F02M 37/08; F02M 37/0047; F02M 37/0058; F02M 45/12; F02M 59/02; F02M 59/102; F04B 23/10; F04B 49/225
USPC ..... 417/2, 203, 205, 206, 28, 29, 244, 307, 417/287, 470, 571; 123/446, 497; 92/86
See application file for complete search history.

(56) References Cited

U.S. PATENT DOCUMENTS 3,495,544 A * 2/1970 Enssle ..... 417/307
3,742,822 A * 7/1973 Talbert ..... 92/86
(Continued)

FOREIGN PATENT DOCUMENTS

CN 101210526 A 7/2008 ..... F02M 37/00
DE 2214184 10/1972 ..... F02M 59/44
(Continued)

OTHER PUBLICATIONS

McMaster-Carr. McMaster-Carr Catalog. 114th ed. Robbinsville: McMaster, 2008. 462-469. Print.*
(Continued)

*Primary Examiner* — Devon Kramer
*Assistant Examiner* — Joseph Herrmann
(74) *Attorney, Agent, or Firm* — Slayden Grubert Beard PLLC

(57) ABSTRACT

A high-pressure pump arrangement (1) which can be especially used for a common rail injection system and has a pump member (2) that contains a low-pressure inlet (8) and a high-pressure outlet (9). A pressurization chamber (12) is provided, within which a plunger (3) is movably mounted and which is connected to the high-pressure outlet via a high-pressure valve (7). Furthermore, a suction chamber (6) that is fitted with a suction valve (5) is provided within the pump member. In addition, an intake duct (13) which extends between the low-pressure inlet and the suction chamber is provided within the pump member. The low-pressure inlet is connected to an electrically regulated pre-supply pump (10) which is permanently operated such that a low pressure is sure to be maintained in the suction chamber (6) of the pump.

10 Claims, 1 Drawing Sheet

(51) Int. Cl.

| | |
|---|---|
| ***F02D 41/38*** | (2006.01) |
| ***F02M 37/00*** | (2006.01) |
| ***F02M 37/08*** | (2006.01) |
| *F04B 23/10* | (2006.01) |

(56) References Cited

U.S. PATENT DOCUMENTS

| | | | | |
|---|---|---|---|---|
| 3,834,838 | A | 9/1974 | Indra | 417/490 |
| 4,982,147 | A * | 1/1991 | Lauw | 318/729 |
| 5,404,855 | A * | 4/1995 | Yen et al. | 123/446 |
| 5,623,910 | A | 4/1997 | Riggle | 123/510 |
| 5,629,590 | A * | 5/1997 | Yamamoto | 318/16 |
| 5,911,208 | A * | 6/1999 | Furusawa et al. | 123/506 |
| 6,230,688 | B1 | 5/2001 | Faix et al. | 123/495 |
| 6,609,500 | B2 * | 8/2003 | Ricco et al. | 123/446 |
| 6,701,898 | B2 * | 3/2004 | Tokuo et al. | 123/456 |
| 6,953,022 | B1 * | 10/2005 | Itsuki et al. | 123/364 |
| 7,207,319 | B2 | 4/2007 | Utsumi | 123/446 |
| 7,640,916 | B2 | 1/2010 | Ulrey et al. | 123/446 |
| 7,644,699 | B2 | 1/2010 | Wolber et al. | 123/447 |
| 7,832,379 | B2 | 11/2010 | Schelhas et al. | 123/510 |
| 2002/0088437 | A1 | 7/2002 | Ricco et al. | 123/457 |
| 2005/0115543 | A1 * | 6/2005 | Rembold et al. | 123/446 |
| 2005/0199219 | A1 | 9/2005 | Utsumi | 123/458 |
| 2006/0228239 | A1 * | 10/2006 | Usui et al. | 417/470 |
| 2008/0019853 | A1 * | 1/2008 | Hashida et al. | 417/490 |
| 2008/0245346 | A1 * | 10/2008 | Onishi et al. | 123/514 |
| 2008/0264384 | A1 | 10/2008 | Kusterer et al. | 123/445 |
| 2008/0283026 | A1 | 11/2008 | Wolber et al. | 123/447 |

FOREIGN PATENT DOCUMENTS

| | | | | |
|---|---|---|---|---|
| DE | 19541086 | A1 | 6/1996 | F02M 69/54 |
| DE | 10058057 | A1 | 6/2002 | F02M 53/00 |
| DE | 102004049286 | A1 | 4/2006 | F02M 37/10 |
| DE | 102007002729 | B3 | 6/2008 | F02M 59/46 |
| DE | 102006061570 | A1 | 7/2008 | F02M 37/00 |
| DE | 102009004590 | A1 | 7/2009 | F02M 37/08 |
| EP | 1195514 | A2 | 4/2002 | F02M 37/00 |
| EP | 1574704 | A2 | 9/2005 | F02M 59/20 |
| WO | 2007/045373 | A1 | 4/2007 | F02M 55/04 |

OTHER PUBLICATIONS

International PCT Search Report and Written Opinion, PCT/EP2009/063924, 20 pages, Apr. 19, 2010.

Chinese Office Action, Application No. 200980147363.5, 24 pages, Nov. 9, 2012.

* cited by examiner

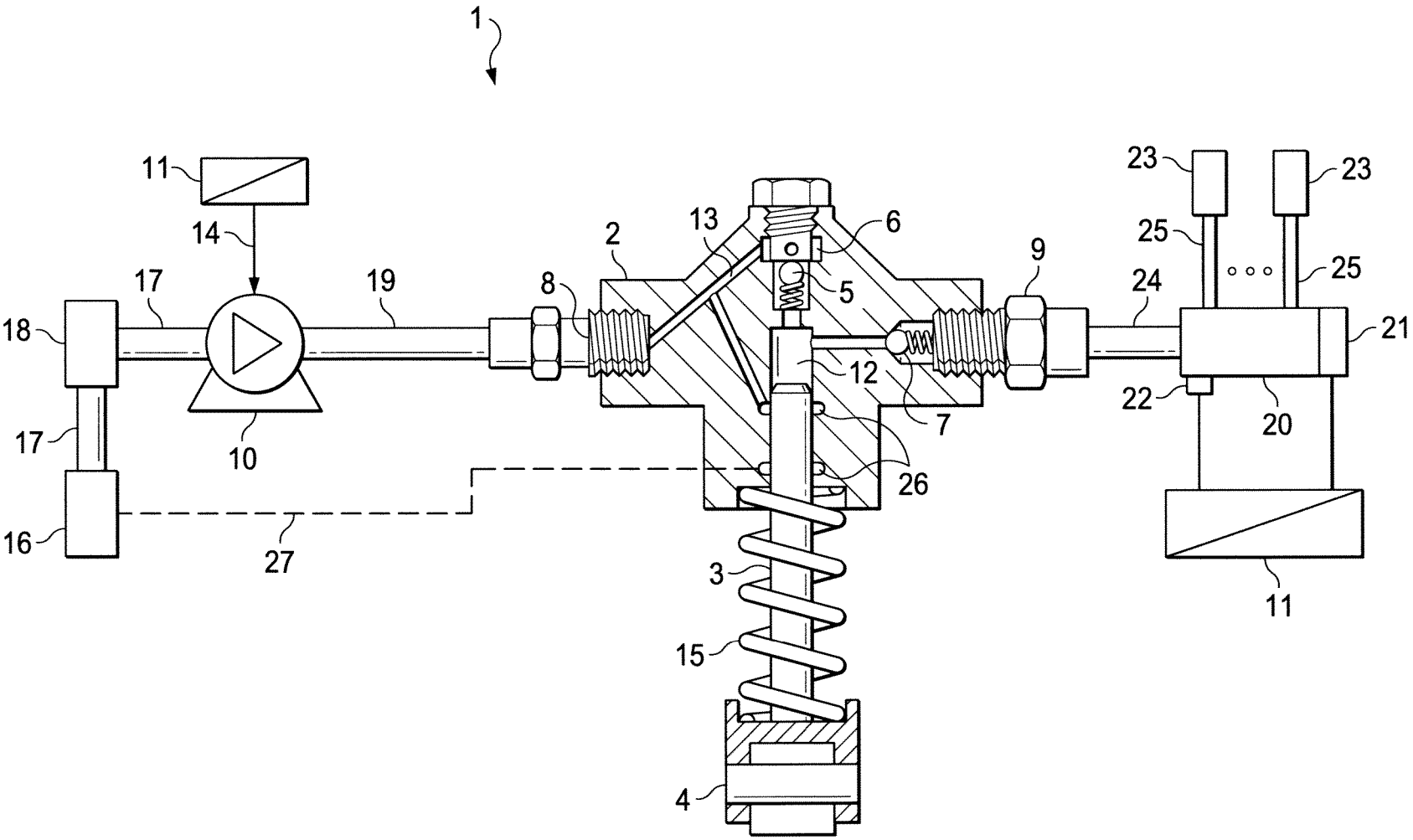
1
2
3
4
5
6
7
8
9
10
11
11
12
13
14
15
16
17
17
18
19
20
21
22
23
23
24
25
25
26
27

HIGH-PRESSURE PUMP ARRANGEMENT

CROSS-REFERENCE TO RELATED APPLICATIONS

This application is a U.S. National Stage Application of International Application No. PCT/EP2009/063924 filed Oct. 22, 2009, which designates the United States of America, and claims priority to German Application No. 10 2008 059 117.3 filed Nov. 26, 2008, the contents of which are hereby incorporated by reference in their entirety.

TECHNICAL FIELD

The invention relates to a high-pressure pump arrangement.

BACKGROUND

Diesel common-rail high-pressure pumps are customarily designed nowadays with a steel housing or an aluminum housing and with an independent camshaft or eccentric shaft.

DE 10 2007 002 729 B3 discloses a fuel pump for injection systems of internal combustion engines and production methods for said fuel pump. Said fuel pump comprises a pump housing with a predetermined installation position. Said pump housing contains one or more pump units and intake-side nonreturn valves which are assigned in each case to the pump units and, at a predetermined opening pressure, each open to let fuel into the assigned pump unit. Each pump unit comprises a pump piston guided in the pump housing in the radial direction with respect to the drive shaft. Upon rotation of the drive shaft, said pump piston is driven by the eccentric shaft section of said drive shaft and by an eccentric ring through which said shaft section passes, to perform a radial reciprocating movement.

Even in the case of small diesel engines, use has recently been made of plug-in pumps which are driven by a camshaft already present in the engine.

WO 2007/045373 A1 discloses a plug-in pump injection system of an internal combustion engine, in which a plug-in pump designed as an injection pump is assigned to each cylinder of the internal combustion engine. Each plug-in pump has a pump housing with a fuel entry duct and a fuel return duct. An annular plate is arranged in the region of the fuel return duct of each plug-in pump, said plate being provided with recesses and engaging in an encircling groove of the pump housing of the respective plug-in pump, the groove forming part of the fuel return duct.

DE 100 58 057 A1 discloses a method for more rapidly heating an internal combustion engine in a starting phase. In this method, the internal combustion engine is supplied with fuel via injectors, wherein the fuel is compressed by a high-pressure pump and conveyed to the injectors, and wherein at least one pressure regulating valve is provided in a high-pressure line between the high-pressure pump and injectors, the outlet of which pressure regulating valve is connected to a tank and which serves to regulate the fuel pressure at the injectors. The fuel which is dispensed at the outlet of the pressure regulating valve and is conducted to the tank is conducted via a heat exchanger. The latter is connected into a cooling circuit of the internal combustion engine in the starting phase of the internal combustion engine and dispenses the excess heat therefrom via the cooling circuit to the cooling water of the internal combustion engine. The high-pressure pump can be combined with the pressure regulating valve and a precompression valve or volumetric flow regulating valve to form a constructional unit.

Furthermore, it is already known to provide a pre-supply pump on the suction side of a fuel high-pressure pump to raise the pressure by a number of bar and to integrate said pump into the housing of the fuel high-pressure pump. Depending on the application, said integrated pre-supply pump is a self-priming pump, or an additional pump is necessary in order to be able to compensate for pressure losses arising between the fuel tank and the pre-supply pump, i.e. in order to be able to maintain a desired minimum pressure. The additional pump may be an electric pump which is provided in the fuel tank.

If the fuel high-pressure pump does not have an independent pump housing and if the camshaft of the motor vehicle is used for driving the piston or plunger of the fuel high-pressure pump, then the above-described integration of a pre-supply pump is no longer possible, and instead an independent electric pre-supply pump is used.

SUMMARY

According to various embodiments, a novel system design for a high-pressure pump arrangement can be specified, in which the fuel and lubricating oil media can be separated and the volumetric flow of fuel can be regulated with a reduced number of components.

According to an embodiment, a high-pressure pump arrangement has—a pump body which has a low-pressure inlet and a high-pressure outlet, —a pressurization chamber which is provided within the pump body and within which a plunger is movably mounted and which is connected to the high-pressure outlet via a high-pressure valve, —a suction chamber which is provided within the pump body and has a suction valve, and—an intake duct which is provided within the pump body and runs between the low-pressure inlet and the suction chamber, wherein—the low-pressure inlet is connected to an electrically regulated pre-supply pump.

According to a further embodiment, the electrically regulated pre-supply pump can be connected to a control unit via a signal connection. According to a further embodiment, According to a further embodiment, the control unit can be provided for supplying control signals to the electrically regulated pre-supply pump via the signal connection. According to a further embodiment, the pre-supply pump can be infinitely variably regulated with regard to the rotational speed thereof. According to a further embodiment, the pre-supply pump can be regulated within a fuel pressure range of 0.1 bar to 3 bar absolute pressure. According to a further embodiment, the pre-supply pump can be used as a throttle. According to a further embodiment, the high-pressure pump may operate in a self-priming manner. According to a further embodiment, the high-pressure pump can be assisted by the pre-supply pump for the purpose of compensating for pressure losses in the fuel entry, at maximum delivery and during operation at geodetic altitudes. According to a further embodiment, the high-pressure pump can be designed in such a manner that pilot control takes place by means of the pre-supply pump and regulation of the pressure takes place by means of a high-pressure regulating valve. According to a further embodiment, the high-pressure regulating valve may operate as a pressure control valve. According to a further embodiment, the high-pressure pump may be designed in such a manner that the fuel pressure in the suction chamber is reduced depending on the operating point in such a manner that regulation of the volumetric flow is achieved. According to a further embodiment, the suction valve may have an opening pressure which is smaller than 1 bar. According to a further embodiment, the fuel pressure in the suction chamber can be set in such a manner that a negative pressure in relation to atmospheric pressure and/or in relation to the pressure in the camshaft chamber of a motor vehicle always prevails. According to a further embodiment, the pump body may have at least one leakage annular groove. According to a further embodiment, at least one leakage annular groove can be connected to the suction chamber. According to a further embodiment, the high-pressure pump can be operated in such a manner that, when maximum delivery is present, the pre-supply pump compensates merely for some of the pressure losses on the suction side in order to maintain the suction effect in the leakage annular groove. According to a further embodiment, the leakage annular groove can be connected to the fuel tank in an unpressurized manner via a fuel return line.

BRIEF DESCRIPTION OF THE DRAWINGS

Further advantageous properties of the invention emerge from the description of an exemplary embodiment with reference to FIG. 1.

DETAILED DESCRIPTION

The advantages of the various embodiments consist in particular in that it is not necessary for a separate volumetric flow regulating valve to be provided between the fuel tank and the high-pressure pump, in that the fuel medium can be separated in a simple manner from the lubricating oil medium, and in that, owing to saving on components, the cost of the high-pressure pump arrangement can be reduced. A high-pressure pump arrangement according to various embodiments can be used in particular in conjunction with diesel engines having a cylinder number of less than or equal to four cylinders and in conjunction with diesel engines having average or small fuel injection quantities.

The latter shows a high-pressure pump arrangement 1 to which a pre-supply pump 10 which can be infinitely regulated electrically and a pump body 2 belong. The pre-supply pump 10 draws fuel out of a fuel tank 16 via a fuel supply line 17, in which a filter 18 is arranged, and conducts said fuel on via a further fuel supply line 19 to the pump body 2. The pre-supply pump 10 can be controlled and regulated with regard to the rotational speed thereof. For this purpose, it receives control signals, for example PWM signals, supplied by the control unit 11 via a signal connection 14.

The pump body 2 has a low-pressure inlet 8 and a high-pressure outlet 9. Furthermore, a pressurization chamber 12 is provided within the pump body 2. A plunger 3 is movably mounted within said pressurization chamber 12 in order, depending on the direction of movement of said plunger, to increase or reduce (suck off) the pressure prevailing in the pressurization chamber 12. The plunger 3 is surrounded by a spring 15, one end region of which is mounted in a cutout in the pump body 2 and the other end region of which is mounted in an element 4 which is operatively connected to the camshaft of the motor vehicle. The spring 15 is compressed or extended upon movement of the plunger 3. The element 4 interacts with the camshaft of the particular motor vehicle in order to bring about the upward and downward movement of the plunger 3.

The pressurization chamber 12 is connected to the high-pressure outlet 9 of the pump body 2 via a high-pressure valve 7.

The fuel provided at the high-pressure outlet 9 is conducted on via a high-pressure line 24 to a high-pressure accumulator (rail) and is supplied from there via further high-pressure lines 25 to injectors 23. A pressure sensor 22 and a high-pressure regulating valve 21, which are both connected to the control unit 11, are provided on the rail 20.

A suction chamber 6 which has a suction valve 5 is provided in the pump body 2. The suction chamber 6 is connected via an intake duct 13 to the low-pressure inlet 8 of the pump body 2. Furthermore, the intake duct 13 is also guided to the pressurization chamber 12 in order to be able to convey fuel out of the intake duct 13 to an annular groove 26 in the piston guide. A high-pressure pump arrangement as shown in FIG. 1 requires neither an integrated pre-supply pump nor a separate volumetric flow regulating valve. It uses merely an electric pre-supply pump 10 which is infinitely variably regulated in terms of rotational speed, is used within a pressure range of between 0.1 bar and 3 bar absolute pressure and can at the same time take on a throttle function.

The pump body 2 with the suction valve 5 arranged therein and with the high-pressure valve 7 operates basically in a self-priming manner. It is assisted by the pre-supply pump 10 only in certain operating situations. Said certain operating situations include, for example, compensation for pressure losses in the fuel supply lines, maximum delivery of fuel, operation at a high geodetic altitude, and starting of the engine.

Regulation of the volumetric flow is realized in the case of the high-pressure pump arrangement shown in FIG. 1 by means of fuel delivery or throttling as the need arises by means of the electric pre-supply pump 10. The latter is activated for this purpose by the control unit 11 using control signals which are supplied to the pre-supply pump 10 via the signal connection 14. By means of suitable activation of the pre-supply pump, the fuel pressure is preferably merely subject to pilot control. The fuel pressure is actually regulated by the high-pressure regulating valve 21 which at the same time takes on the function of a pressure control valve and is constructed as a separate component on the high-pressure accumulator 20 (rail).

The fuel pressure in the suction chamber 6 of the pump body 2 is reduced or throttled depending on the operating point until the desired effect of suction throttling and therefore regulation of the volumetric flow is achieved. The suction valve 5 is designed for this operating mode and operates, for example, at an opening pressure which is smaller than 1 bar. Separation of the fuel and lubricating oil media is realized by the fuel pressure in the suction chamber 6 being set in such a manner that a negative pressure in relation to atmosphere or in relation to the pressure in the camshaft chamber of the particular motor vehicle always arises.

In an advantageous manner, at least one leakage annular groove 26, which is connected to the suction chamber 6, is provided in the pump body 2. A suction effect is produced in the leakage annular groove by the negative pressure in the suction chamber 6. This prevents fuel from overflowing into the lubricating oil. Since such a system is operated only in rare situations with the effect of maximum delivery, the suction throttling and therefore the negative pressure described is the normal operating state. In the rare cases of maximum delivery, the electric pre-supply pump only has to compensate for some of the pressure losses on the suction side in order to maintain the suction effect in the leakage annular groove.

The deterioration in the hydraulic efficiency which can be expected can be accepted because of the preferably small injection quantities or can be compensated for in the design of the pump.

The negative pressure which is always present in the leakage annular groove makes additional measures which are otherwise necessary for preventing oil dilution unnecessary. The position of the leakage annular groove in the pump body 2 is selected in such a manner that oil dilution is prevented and penetration of lubricating oil into the fuel is minimizes. Penetration of lubricating oil into the fuel could have a negative effect on coking of injection nozzles and on the combustion process, this being prevented in the case of a high-pressure pump arrangement according to various embodiments.

As an alternative to connecting the leakage annular groove to the suction chamber 6, it is also possible to connect the leakage annular groove to the fuel tank via a fuel return line 27 in order to convey fuel back into the tank 16 in an unpressurized manner. All that is needed in this case is to replace the function of regulation of the volumetric flow by suction throttling.

What is claimed is:

1. A high-pressure pump arrangement to be attached to a camshaft housing and to be driven by a camshaft of a motor vehicle comprising:

a pump body which has a low-pressure inlet connected to a fuel supply line and a high-pressure outlet connected to a high pressure accumulator, the pump body having a leakage annular groove, a pressurization chamber which is provided within the pump body and within which a plunger is movably mounted and which is connected to the high-pressure outlet via a high-pressure valve, a suction chamber which is provided within the pump body and has a suction valve, an intake duct which is provided within the pump body and runs between the low-pressure inlet and the suction chamber, wherein the leakage annular groove is connected to the low-pressure inlet and the suction chamber via the intake duct, and an electrically regulated pre-supply pump connected to the low-pressure inlet, wherein the pre-supply pump is configured to operate as a throttle for regulation of volumetric flow and to maintain a fuel pressure level in the suction chamber that lies below at least one of atmospheric pressure and a pressure in a camshaft chamber of the motor vehicle in order to produce a suction effect in the leakage annular groove.

2. The high-pressure pump arrangement according to claim 1, wherein the pre-supply pump can be infinitely variably regulated with regard to the rotational speed thereof.

3. The high-pressure pump arrangement according to claim 1, wherein the pre-supply pump can be regulated within a fuel pressure range of 0.1 bar to 3.0 bar absolute pressure.

4. The high-pressure pump arrangement according to claim 1, wherein the high-pressure pump operates in a self-priming manner.

5. The high-pressure pump arrangement according to claim 1, wherein the pre-supply pump is configured to assist the high-pressure pump for the purpose of compensating for pressure losses in the intake duct, in case of maximum delivery and during operation at high geodetic altitudes.

6. The high-pressure pump arrangement according to claim 1, wherein the high-pressure pump arrangement is configured such that the pre-supply pump operates a pilot control for the fuel pressure within the high pressure accumulator and regulation of the pressure within the high pressure accumulator is carried out by a high-pressure regulating valve.

7. The high-pressure pump arrangement according to claim 6, wherein the high-pressure regulating valve operates as a pressure control valve.

8. The high-pressure pimp arrangement according to claim 1, wherein the suction valve has an opening pressure which is smaller than 1.0 bar.

9. The high-pressure pump arrangement according to claim 1, configured in such a manner that, when the high-pressure pump is operated at maximum delivery, the pre-supply pump compensates merely for some of the pressure losses in the intake duct in order to maintain the suction effect in the leakage annular groove.

10. A method for operating a high-pressure pump arrangement to be attached to a camshaft housing and to be driven by a camshaft of a motor vehicle, comprising:

providing a pump body which has a low-pressure inlet connected to a fuel supply line and a high-pressure outlet connected to a high pressure accumulator, providing a pressurization chamber within the pump body and within which a plunger is movably mounted and which is connected to the high-pressure outlet via a high-pressure valve, providing a suction chamber within the pump body which has a suction valve, providing an intake duct within the pump body which runs between the low-pressure inlet and the suction chamber, and providing at least one leakage annular groove arranged in the pump body surrounding the plunger and connected to the intake duct and connected to the suction chamber and the low-pressure inlet via the intake duct as well as providing an electrically regulated pre-supply pump connected to the low-pressure inlet, and operating the pre-supply pump as a throttle for regulation of the volumetric flow and to maintain a fuel pressure level in the suction chamber below to at least one of atmospheric pressure and a pressure in a camshaft chamber of the motor vehicle in order to produce a suction effect in the leakage annular groove.

* * * * *